US005096097A

United States Patent [19]

Lina

[11] Patent Number: 5,096,097

[45] Date of Patent: Mar. 17, 1992

[54] MANUALLY-OPERATED PRECOMPRESSION TYPE SPRAY HEAD

[75] Inventor: Jean-Pierre Lina, Le Neubourg, France

[73] Assignee: Valois, Le Neubourg, France

[21] Appl. No.: 497,282

[22] Filed: Mar. 22, 1990

Related U.S. Application Data

[63] Continuation-in-part of Ser. No. 242,462, Sep. 9, 1988, Pat. No. 4,964,547.

[30] Foreign Application Priority Data

Sep. 9, 1987 [FR] France ..... 87 12496

[51] Int. Cl.[5] ..... B67D 5/40

[52] U.S. Cl. ..... 222/385; 222/402.16; 222/321; 141/20; 251/347; 251/353

[58] Field of Search ..... 222/382-385, 222/402.1, 402.12, 402.16, 402.2, 484, 321, 341; 239/337; 141/3, 20; 251/347, 348, 353, 354

[56] References Cited

U.S. PATENT DOCUMENTS

| | | | |
|---|---|---|---|
| 2,612,293 | 9/1952 | Michel | 222/402.16 |
| 2,802,490 | 8/1957 | Ward | 222/402.16 |
| 3,108,721 | 10/1963 | Nebinger | 222/402.16 |
| 3,211,346 | 10/1965 | Meshberg | 222/402.12 |
| 3,250,474 | 5/1966 | McKernan | 222/402.12 |
| 4,025,046 | 5/1977 | Boris | 222/321 |
| 4,271,875 | 6/1981 | Meshberg | 222/402.16 |
| 4,365,729 | 12/1982 | Saito et al. | 222/321 |
| 4,503,997 | 3/1985 | Corsette | 222/402.16 |
| 4,842,168 | 6/1989 | Bougamont et al. | 222/402.16 |
| 4,944,432 | 7/1990 | Jouillat | 222/385 |
| 4,964,547 | 10/1990 | Lina | 222/385 |

FOREIGN PATENT DOCUMENTS 2407752 4/1987 France .

*Primary Examiner*—Robert P. Olszewski
*Assistant Examiner*—Steve Reiss
*Attorney, Agent, or Firm*—Sughrue, Mion, Zinn, Macpeak & Seas

[57] ABSTRACT

A spray head for use with a receptacle containing a liquid which is maintained under pressure by a propellant gas, thereby enabling a product to be packaged so that it is protected from coming into contact with the air, the spray head being of the type comprising a manually-operated precompression pump which includes a pump chamber comprising first and second cylinders (11, 15) capable of engaging telescopically, the chamber being closed by relative displacement of the cylinders, said first cylinder being integral with the pump outlet valve and being provided at one of its end with a circular sealing lip (12) capable of engaging against and of sliding along the wall of the second cylinder, which second cylinder is in communication with the inside of the receptacle, the wall being provided at at least one of its ends with relief (18) such that when the sealing lip lies over the relief and the relief causes sealing to be broken, a passage is opened suitable for passing gas at a rate of flow which is sufficient for filling the receptacle.

9 Claims, 2 Drawing Sheets

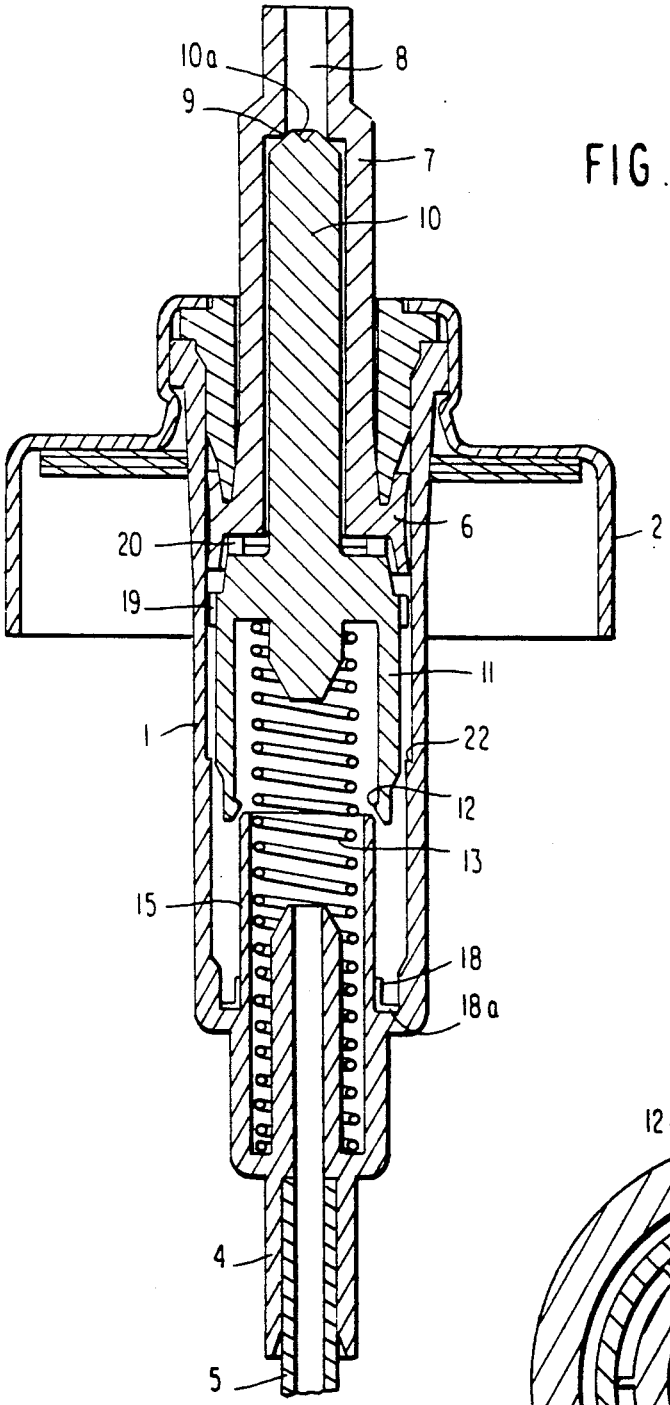
FIG. 1
FIG. 3
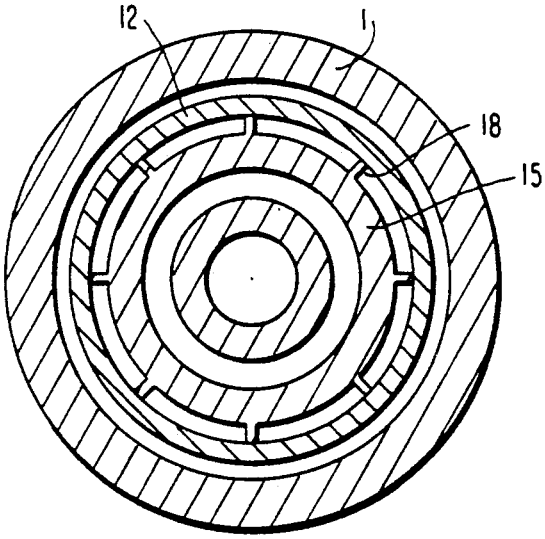

MANUALLY-OPERATED PRECOMPRESSION TYPE SPRAY HEAD

This is a continuation-in-part of application Ser. No. 07/242,462 filed Sept. 9, 1988 and now U.S. Pat. No. 4,964,547, of Oct. 23, 1990.

The present patent application is a "continuation in part" from a pending application relating to a spray head device of the manually-operated precompression type and usable for atomizing a liquid contained in a receptacle.

The invention relates more particularly to a spray head for use with a receptacle containing a liquid which is maintained under pressure by a propellant gas for the purpose of protecting the liquid content from coming into contact with the air and also for the purposes of facilitating priming of the pump and of ensuring that the pump chamber is filled more quickly and more completely. The propellant gas (e.g. freon) may be dissolved in the liquid, or else it need not be dissolved (e.g. nitrogen).

BACKGROUND OF THE INVENTION

A suitable prior art pump includes a pump chamber comprising first and second telescopically-slidable cylinders with the pump chamber being capable of being closed by relative displacement of the cylinders. The first cylinder is integral with the pump outlet valve and is provided at one of its ends with a circular sealing lip capable of engaging against and of sliding along the wall of the second cylinder, which second cylinder is in communication with the inside of the receptacle. When the facing edges of the two cylinders at a distance are apart from each other, the gap between the two edges allows communication to take place between the pump chamber and the inside of the receptacle. When one of the cylinders is engaged inside the other, this communication is interrupted and the pump chamber is isolated, thus providing a pump chamber which is annular in shape and which surrounds said two cylinders. Such pumps are described, for example, in French patents numbers 2 305 241 and 2 314 772 and in the corresponding U.S. Pat. No. 4,025,046. The pumps described in these patents are used without a propellant gas. They could naturally also be used with a propellant gas by ensuring that there is no communication with the outside atmosphere, i.e. that the volume of liquid expelled by the pump is not replaced by a volume of air. However, this raises the problem of inserting the propellant gas into the receptacle after the receptacle has been filled with liquid and the pump has been put into place and crimped onto the receptacle.

An object of the present invention is to make it possible to fill the volume left empty in the receptacle with the propellant gas in a manner which is both simple and reliable.

French patent number 2 407 752 describes a precompression pump for atomizing a liquid, but in which no provision is made for receiving a gas under pressure in order to prevent the entry of air to replace the volume of liquid that is ejected. In this prior pump, as in the other pumps mentioned above, the outlet valve opens only when the pressure in the chamber reaches a certain value. When the pump is primed, the chamber is filled with liquid. If the volume of the chamber is reduced, then the pressure rises to a high value very quickly since the liquid is incompressible, so the valve member lifts and the liquid is expelled. However, when the pump is first used, its chamber is filled with air so reducing the volume of the chamber raises the gas pressure relatively little and the valve member does not lift. The air stagnates in the chamber and initial pump priming is made difficult. The pump described in said patent includes means for facilitating such priming, or even for making priming possible. To this end, a spline is provided on the second cylinder for putting the volume of the pump chamber into communication with the inside of the receptacle when the pump is actuated to its fullest extent. As described in greater detail below, passages are thus disengaged level with the sealing lip. The cross-section of these passages is very small. They serve solely for evacuating the volume of air from the chamber. In addition, the pump position required for obtaining such evacuation must necessarily be obtained by normal manual actuation of the pump.

The present invention relates to means making it possible to insert gas into the receptacle after it has been filled with liquid, with the quantity of gas inserted being sufficient to prevent any air from entering the receptacle until all of the liquid has been expelled therefrom.

To this end, the original application from which this is a "continuation in part" teaches forming grooves or notches on the edge of the second cylinder at its end furthest from the receptacle, i.e. adjacent the outlet valve on the pump. In addition, means such as a needle are provided for pushing back the first cylinder so that its sealing lip comes level with these notches and simultaneously the outlet valve of the pump is kept open. This has the effect of establishing a path from the outside of the pump into the receptacle whereby the propellant gas may be injected at a rate compatible with performing the required filling on an industrial scale. This way of adapting prior pumps is indeed easily done. However, the pumps then suffer from the drawback of having their piston stroke reduced by a distance equal to the height of the notches. In other words, there is a delay in isolating the pump chamber from the receptacle for the purpose of putting the quantity of liquid to be sprayed under pressure. In addition the quantity of liquid is itself correspondingly reduced, thereby degrading pump capacity.

SUMMARY OF THE INVENTION

The present continuation in part seeks to provide a pump which avoids the above-mentioned drawback in the teaching of the original application. To do this, relief is provided comparable to the preceding grooves or notches, but this time the relief is disposed at the end of the second cylinder which lies adjacent to the receptacle, i.e. at its end furthest from the outlet valve. Thus, as before, when the first cylinder receives sufficient thrust from external thrust means for it to be moved into a "filling" position relative to the second cylinder, in which position the outlet valve is open while the sealing lip is level with the relief and is therefore not in sealing contact with the second cylinder, communication with the outside of the receptacle is established through the pump, thereby enabling propellant gas to be inserted into the receptacle in a period of time compatible with industrial application (i.e., short enough for ensuring an industrial production cadence). However, in the present case, it is also possible to provide the pump with abutment means preventing the filling position being reached during normal manual operation of the pump.

Advantageously, the relief is constituted by a plurality of ribs which are regularly disposed around and project from the second cylinder so that each of them has a top edge, with the edges of the ribs being inclined to the horizontal at an angle of not more than 40°, thereby constituting said abutment means.

In a particular example, the second cylinder has a mean diameter of about 5 mm, with said ribs then projecting by about 0.5 mm, such that the thrust required to bring the first cylinder into the filling position is greater than 3 kgf, and one second suffices for filling the propellant gas.

In another embodiment of the present invention, the relief is constituted by a plurality of grooves with the abutment means consisting in means for limiting the stroke of the pump system. These means may be constituted, for example, by a peripheral step formed on the inside wall of the pump body.

In either case, it is advantageous for the valve member to be designed so as to be capable of being pushed back by a needle so as to cause the valve to be opened by a filling machine. Instead of being terminated by a point as is conventional, the valve member may therefore include a central needle-receiving flat or small dent at its end.

Clearly the differences in structure that can be emphasized between the present invention and the prior art pump including a single priming spline is a question of dimensions: e.g. size and number of ribs. Thus at first view these differences may appear to be non-patentable. However, they govern novel effects which the prior art version does not suggest in any case. It was never envisaged that the prior art version should be used in association with a receptacle containing a propellant gas for the purpose of injecting the gas therethrough. Thus, the present invention also constitutes the use of the present pump in the context of filling the receptacle with propellant gas.

BRIEF DESCRIPTION OF THE DRAWINGS

Embodiments of the invention are described by way of example with reference to the accompanying drawings, in which:

FIG. 1 is an axial section through a precompression pump constituting a first embodiment of the invention and shown in its rest state;

FIG. 3 is a cross section on plane I—I of FIG. 2; and

MORE DETAILED DESCRIPTION

Figure 4:
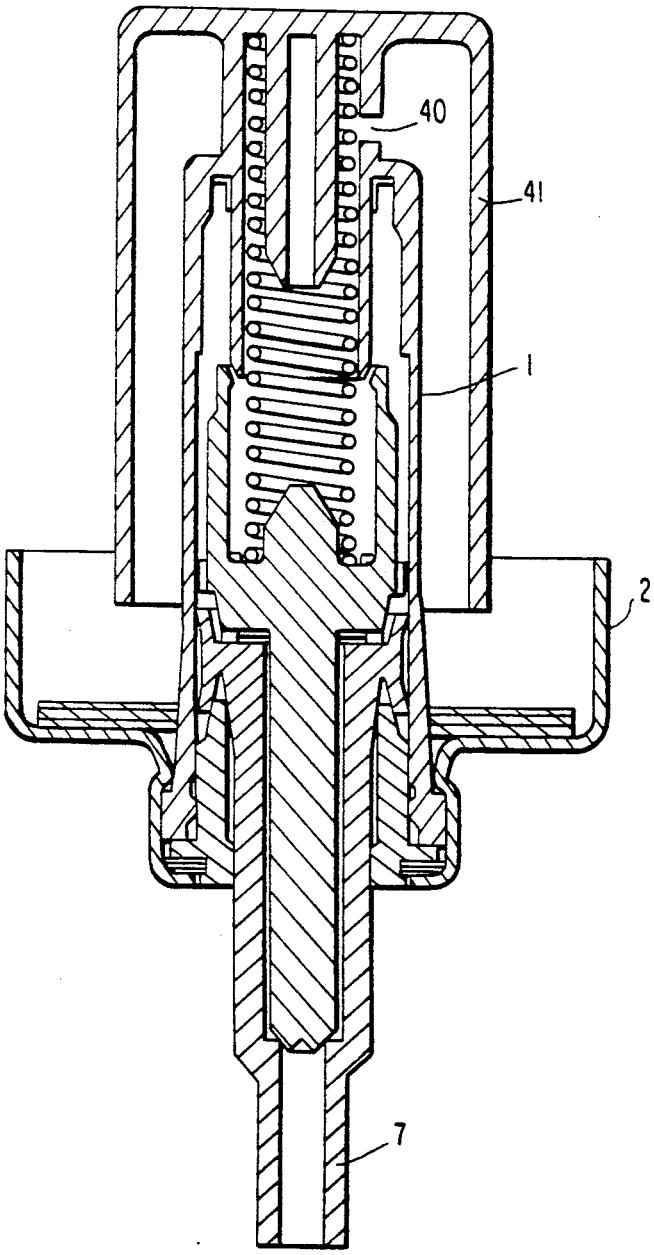
FIG. 4 is a section view through a pump in accordance with the invention and designed for use in the upsidedown position.

The pump shown in axial section in the figures operates in well-known manner except, naturally, with respect to the modification of the present invention. The pump is provided for being received in the opening of a receptacle. It comprises a pump body 1 whose top end is crimped in a capsule 2 which is provided for the purpose of being crimped in turn to the neck of a receptacle (not shown) together with appropriate interposed sealing rings. The bottom portion presents a collar 4 in which or on which a dip tube 5 is engaged. A piston 6 is free to slide inside the pump body and is integral with a rod 7 which projects outside the pump. An ejection channel 8 passes through the rod and the piston. A pushbutton is provided for fitting onto the top end of the rod 7 in order to push down the rod together with the piston. A valve seat 9 is formed in conventional manner in the channel 8 and the seat is engaged with a valve member constituted by a pin 10 which is integral with a first cylinder 11 having a sealing lip 12 at its bottom end. The valve member is urged upwardly into its closure position by a spring 13 which bears downwardly against the bottom of the pump body. The first cylinder is designed to be capable of moving downwardly around a second cylinder 15 which is fixed to the bottom of the pump body. In the rest state, the valve member is urged upwardly by the spring 13 and drives the piston upwardly until it reaches its abutment position, with the valve being kept closed. In the rest position (as shown in FIG. 1), the first and second cylinders are separate from each other. There is an annular passage between them enabling the chamber to be filled both by suction and under the effect of a propellant gas. When the piston is pressed down, the sealing lip 12 engages around the second cylinder 15, thereby closing the annular passage and defining an annular pump chamber between the pump body 1 and the first and the second cylinders 11 and 15. As the piston continues to move downwardly, the volume of the pump chamber is reduced, thereby compressing the product contained therein until the pressure is sufficient to be in equilibrium with the spring 13 and then to counterbalance it, thereby causing the valve member 10 to move down together with the cylinder 11 whose lip 12 is sliding along the second cylinder 15. The product can then escape via the channel 8 so long as the pressure in the chamber remains greater than the pressure due to the action of the spring 13. The above description is conventional and the pump as described constitutes one of the embodiments shown in the above-mentioned patents. The present invention is applicable to all of the embodiments described therein.

Figure 2:
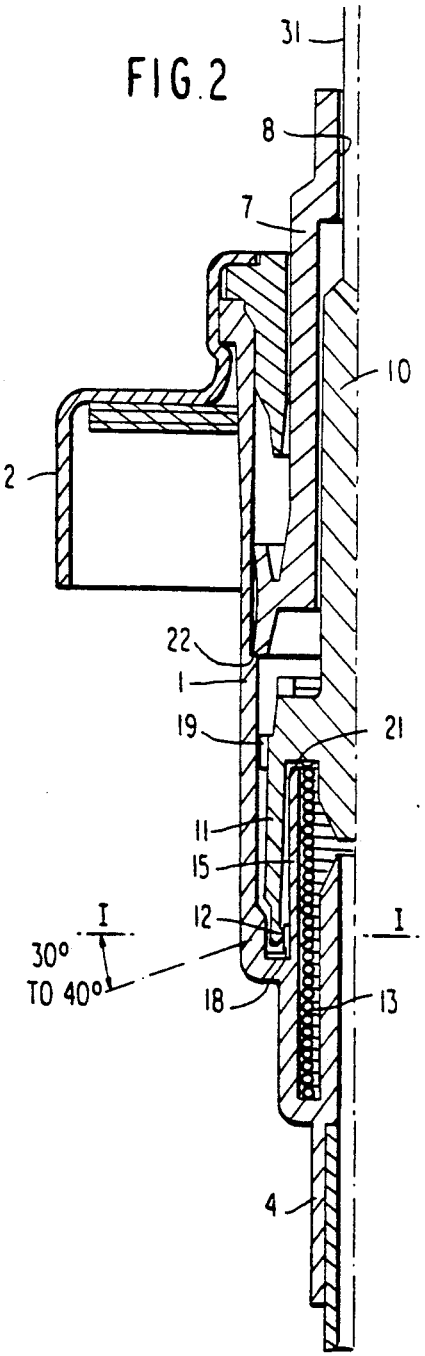
FIG. 2 is a fragmentary axial section showing the FIG. 1 pump in its filling position.

In one embodiment of the present invention as shown in FIGS. 1 to 3, relief is formed around the bottom of the second cylinder 15 at the bottom of the pump chamber. Although the relief could in theory be constituted by hollow grooves, it is more advantageously constituted in the present case by ribs 18 extending axially and disposed regularly around the periphery of the second cylinder 15. For example, as can be seen more clearly in FIG. 3, four diametrically opposite pairs of ribs 18 may be provided. These ribs advantageously project by about 0.5 mm from the surface of the second cylinder when the diameter of the second cylinder is about 5 mm to 6 mm.

In addition, it is recommended for the top ends thereof to be chamfered so as to slope radially at an angle of 30° to 40° to the horizontal (cf. FIG. 2).

So long as the sealing lip 12 engages the outside surface of the second cylinder 15 above the ribs 18 it provides sealing and the pump chamber is closed so that liquid contained therein can only escape by unseating the pin. However, if the valve body is moved down, e.g. by means of a needle 31 (c.f. FIG. 2), until the sealing lip engages the ribs 18 then sealing is no longer provided.

In fact, this operation requires relatively large external pressure to be exerted on the needle 31. In addition to the return force of the spring 13 and the friction of the lip 12 on the second cylinder 15, the corresponding force needs to overcome the resistance to deformation provided by the first cylinder 11 whose outside diameter must increase sufficiently to pass over the ribs 18. The small slope relative to the horizontal of their respective ends facilitates this engagement very little, particularly since the deformation required of the lip 12 is not localized. As a result only a machine such as an actuator is capable of transmitting the desired thrust to the needle 31 since the value of the thrust is considerably greater than the 1 kgf to 6 kgf developed manually during normal operation of the pump.

In fact, this characteristic is highly favorable. It removes any danger of the lip 12 moving over the ribs 18 after dispensing a measured quantity of fluid. This avoids any danger of the user unintentionally putting the receptacle into communication with the pump chamber at a moment when the pump chamber is at a pressure greater than that inside the receptacle which would have the undesirable effect of returning a portion of the quantity to be emitted back into the receptacle, thereby spoiling pump capacity or interferring with the reproducibility of spray operations.

The needle 31 advantageously bears against the top of the pin 10 while inserted in the ejection channel 8. In order to facilitate this operation, the central portion of the pin is formed with a small dent 10*a* which automatically centers the needle 31 and prevents it from being deflected sideways. Although it is preferable to provide a dent, a small flat would suffice.

In any event, the effect of pushing down the needle 31 is not only to raise the sealing lip 12 over the ribs 18, but also to lift the pin 10 off its seat 9, thereby opening the outlet valve (cf. FIG. 2). Once this has happened, uninterrupted communication exists from the outside into the receptacle, passing through the pump.

The corresponding path also has a relatively large cross-section. Level with the ribs 18, i.e. at the smallest section portion of the path, the section corresponds to a ring which is about 0.5 mm wide and about 5 mm in mean diameter. This is much larger than the annular passages having a thickness of 4/100 of a millimeter as provided in the earlier pump provided with a single priming spline, as mentioned in the prior art to the present application. As a result, leakage rates can be established which are up to 1000 times greater. The propellant gas can thus be inserted into the receptacle over this path at rates which are compatible with the time available for performing such a filling operation in an industrial installation. It is recalled that the pressure inside the receptacle may be raised in this way from atmospheric pressure to 3 or 4 atmospheres in the period of about one second.

In order to ensure that the pump operates properly under all circumstances, both while being filled with propellant gas and during normal operation, it is possible to provide means for preventing the substance-passing passages from being blocked in untimely manner. Thus, in order to prevent the passage being blocked by the bottom edge of the first cylinder 11 pressing against the bottom of the pump chamber when the first cylinder is pushed down fully, the ribs 18 are provided with 90° extensions 18*a* in the bottom of the chamber. In order to guide the valve member against the inside wall of the pump body without blocking the passage, the valve member is advantageously provided with guide ribs 19.

In order to ensure that there is always a free passage between the pin and the inside, it is also possible to provide ribs 20 on the top of the widened portion of the valve member between the first cylinder 11 and the rod of the pin. Finally, ribs 21 are provided at the bottom of the first cylinder 11 in order to prevent the passage from being blocked by the top edge of the second cylinder when the first cylinder is pushed down fully (c.f. FIG. 2). Naturally, the sizes of the various ribs and rib portions 18*a*, 19, 20, and 21 should be compatible with the size of the rib 18 to ensure the authorized gas flow rates.

In normal use, the user may be prevented from moving the valve member to its extreme bottom position where the sealing lip 12 is level with the ribs 18 (e.g. by virtue of the user pressing too hard on the pushbutton, or in the event of the relief being constituted by grooves), it is possible to provide means for limiting the stroke of the piston. In the embodiments shown in FIGS. 1 and 2, a step 22 is provided on the inside wall of the pump body: this positively limits the piston down stroke and consequently the down stroke of the valve member at a desired height. It may be observed that in FIG. 2 the valve member is shown in its lowest position with the spring being fully compressed.

A pump in accordance with the invention may be designed for use in the upsidedown position (FIG. 4). In this application, the liquid product enters the pump body via a side hole 40 situated above the pump chamber, and the bottom of the pump body is closed. In particular, there is no collar for connecting a dip tube. In order to use as much product as possible, i.e. in order to recover the quantity of product situated beneath the level of the hole 40 when the pump (and the receptacle in which it is mounted) is in the upsidedown position, the body of the pump is provided with an upwardly directed cup 41 (which is downwardly directed when in the upsidedown position) extending to the vicinity of the capsule.

I claim:

1. A spray head for use with a receptacle containing a liquid which is maintained under pressure by a propellant gas, thereby enabling a product to be packaged so that it is protected from coming into contact with the air, the spray head being of the type comprising a manually-operated precompression pump which includes a pump chamber comprising first and second cylinders capable of engaging telescopically, said chamber being closed by relative displacement of said cylinders, said first cylinder being integral with the pump outlet valve and being provided at one of its ends with a circular sealing lip capable of engaging against and of sliding along the wall of said second cylinder, which second cylinder is in communication with the inside of the receptacle, said wall being provided at its end adjacent to the receptacle with a relief and the first cylinder being adapted to receive thrust transmitted by external thrust means so as to be capable of being brought into a "filling" position relative to the second cylinder in which position the outlet valve is open and simultaneously the sealing lip lies over the relief and is no longer in sealed contact with the second cylinder, thereby establishing communication between the outside and the receptacle through the pump while in its filling position and enabling the receptacle to be filled with propellant gas within a period of time which is short enough for ensuring an industrial production cadence, the pump further including abutment means for preventing the filling position from being reached during normal manual operation of the pump.

2. A spray head according to claim 1, wherein the external thrust means comprise a needle having two end tips, one needle tip being fixed to an actuator, and wherein the outside top end of the first cylinder valve has a flat or a hollow suitable for receiving the other tip of the needle.

3. A spray head according to claim 1, wherein the relief is constituted by a plurality of ribs regularly disposed around and projecting from the second cylinder, with each rib presenting a top edge, the top edges of the ribs being inclined to the horizontal at an angle of no more than 40°, thereby constituting said abutment means.

4. A spray head according to claim 3, wherein the second cylinder has a mean diameter of about 5 mm, with said ribs then projecting through about 0.5 mm.

5. A spray head according to claim 1, wherein the relief is constituted by a plurality of grooves, said abutment means being constituted by means for limiting the stroke of the pump piston.

6. A spray head according to claim 5, wherein the means for limiting the stroke of the pump piston are constituted by a peripheral step formed on the inside wall of the pump body.

7. A method of utilizing a spray head of the precompression manual pump type, suitable for use in packaging a substance to be protected from the air, in association with a receptacle containing a liquid maintained under pressure by a propellant gas, said pump having a pump chamber comprising first and second cylinders capable of engaging telescopically, said chamber being closed by relative sliding motion of two cylinders, the first cylinder being fixed to a pump outlet valve provided at one of its ends with a circular sealing lip capable of engaging over and of sliding along the second cylinder which is in communication with the inside of the receptacle, the wall of the second cylinder over which the sealing lips of the first cylinder slides being provided at its end adjacent to the receptacle with a relief, said method comprising the following steps:

transmitting thrust to the first cylinder with the help of external thrust means in such a way that the first cylinder is moved to a "filling" position relative to the second cylinder in which position the outlet valve is opened and simultaneously the sealing lip lying over the relief is no longer in sealing contact with the second cylinder, communication thus being established between the outside and the receptacle through the pump when in its filling position; and injecting through the outlet valve propellant gas within a period of time which is short enough for ensuring an industrial production cadence, the filling position being prevented from being reached during normal manual actuation of the pump by virtue of abutment means provided in the pump.

8. The method according to claim 7, wherein the external thrust means comprise a needle having two end tips, one tip being fixed to an actuator and the other tip bearing against the top end of the valve of the first cylinder in order to push it back.

9. A spray head for use with a receptacle containing a liquid which is maintained under pressure by a propellant gas, thereby enabling a product to be packaged so that it is protected from coming into contact with the air, the spray head being of the type comprising a manually-operated precompression pump which includes a pump chamber comprising first and second cylinders capable of engaging telescopically, said chamber being closed by relative displacement of said cylinders, said first cylinder being integral with the pump outlet valve and being provided at one of its ends with a circular sealing lip capable of engaging against and of sliding along the wall of said second cylinder, which second cylinder is in communication with the inside of the receptacle, said wall being provided at its end adjacent to the receptacle with a relief constituted by a plurality of ribs regularly disposed around and projecting from the second cylinder, with each rib presenting a top edge, the top edges of the ribs being inclined to the horizontal at an angle of no more than 40°, and the first cylinder being adapted to receive thrust transmitted by external thrust means so as to be capable of being brought into a "filling" position relative to the second cylinder in which position the outlet valve is open and simultaneously the sealing lip lies over the relief and is no longer in sealed contact with the second cylinder, thereby establishing communication between the outside and the receptacle through the pump while in its filling position and enabling the receptacle to be filled with propellant gas within a period of time which is short enough for ensuring an industrial production cadence, the pump further including means for limiting the stroke of the pump piston constituted by a peripheral step formed on the inside wall of the pump body, the filling position being prevented from being reached during normal manual actuation of the pump by virtue of the top edges of the ribs together with the peripheral step.

* * * * *